United States Patent [19]

Johnson

[11] 4,187,681

[45] Feb. 12, 1980

[54] HYDROSTATIC WINCH

[75] Inventor: Kenneth V. Johnson, Oconomowoc, Wis.

[73] Assignee: Bucyrus-Erie Company, South Milwaukee, Wis.

[21] Appl. No.: 937,578

[22] Filed: Aug. 28, 1978

[51] Int. Cl.[2] ..... F15B 20/00; F15B 15/22

[52] U.S. Cl. ..... 60/395; 60/403; 60/905; 254/150 FH

[58] Field of Search ..... 60/395, 403, 406, 435, 60/905, DIG. 2; 254/150 FH, 173 R

[56] References Cited

U.S. PATENT DOCUMENTS

| | | | |
|---|---|---|---|
| 3,381,939 | 5/1968 | Brown et al. | 60/490 X |
| 3,685,290 | 8/1972 | Krusche | 60/905 X |
| 3,943,713 | 3/1976 | Walton | 60/395 |
| 3,943,714 | 3/1976 | Reinker | 60/403 |

*Primary Examiner*—Edgar W. Geoghegan
*Attorney, Agent, or Firm*—Quarles & Brady

[57] ABSTRACT

A hydrostatic winch having a hydraulic drive system with a dual control valve which adjusts pressure in control lines for varying the speed of lowering and hoisting a load and a brake for stopping the load has an overspeed control system which includes first valve means for relieving pressure in the control lines and first valve control means which opens the valve to automatically slow the speed of the winch when the load is moving too fast and a fail safe system for smoothly stopping the load, if necessary, which includes a braking system having a normally "off" brake which is biased towards an "on" position but which is held in the "off" position by a hydraulic cylinder. The braking system also includes a first means for determining when the speed of the load or winch exceeds a predetermined safe rate, second means for detecting the occurrence of an abnormal condition which can cause overspeed, second valve means for bleeding pressure from the hydraulic cylinder and second valve control means which upon receipt of a signal from either the first or second means will open the valve to proportionately bleed hydraulic pressure from the hydraulic cylinder of the brake so as to apply the brake to smoothly stop the load. In a preferred embodiment the fail safe system includes an operator control override system.

10 Claims, 2 Drawing Figures

HYDROSTATIC WINCH

BACKGROUND OF THE INVENTION

This invention relates to a hydrostatic winch, and more particularly, to a hydrostatic winch having a hydraulic control system with a dual valve which controls the hoisting and lowering speed of the winch and a brake for stopping the load, if necessary.

Hydrostatic winches for hoisting or lowering loads operate most efficiently at relatively high speeds and relatively constant horsepower. However, winches run at speeds near their upper limits can enter into an overspeed condition, especially when lowering a load. An overspeed condition should be quickly identified and corrected to prevent damage to the winch system.

Several control systems have been proposed to prevent overspeed damage. The control system described in U.S. Pat. No. 3,943,713 issued to Erlen Walton for a "Control Arrangement" compares the actual speed of the winch motor to a desired speed as defined by a reference speed motor using a gear arrangement, and adjusts the displacement of the pump and motor of the winch drive accordingly. The Walton winch also includes a braking system for quickly bringing the load to an abrupt stop in the event that an abnormal condition occurs such as a broken hydraulic line or high pump or motor case drain pressure. U.S. Pat. No. 3,685,290 issued to Alfred Krusche for an "Overload System for a Hydrostatic-Drive Apparatus" also discloses a braking system which brings the load to an abrupt stop.

The hydrostatic winch of the present invention includes not only an improved overspeed control system, but also an improved fail safe system for smoothly stopping the load to eliminate the strain placed on the winch system by abrupt braking of the load.

SUMMARY OF THE INVENTION

The present invention relates to a hydrostatic winch having a hydraulic drive system with a dual control valve which adjusts pressure in control lines for varying the speed of lowering and hoisting a load, a brake for stopping the load, an overspeed control system which includes first valve means for relieving pressure in the control lines and first valve control means which opens the valve to automatically slow the speed of the winch when the load is moving too fast and a fail safe system for smoothly stopping the load, if necessary, which includes a braking system having a normally "off" brake which is biased towards an "on" position but which is held in the "off" position by a hydraulic cylinder. The fail safe braking system also includes a first means for determining when the speed of the load or winch will exceed a predetermined safe rate, second means for detecting the occurrence of an abnormal condition which can cause overspeed, second valve means for bleeding pressure from the hydraulic cylinder and second valve control means which upon receipt of a signal from either the first or second means will open the valve to proportionately bleed hydraulic pressure from the hydraulic cylinder of the brake so as to apply the brake to smoothly stop the load.

In the preferred form, the fail safe system also includes means for neutralizing and overriding the dual control valve used by the winch operator to lower or hoist the load.

It is the general object of the invention to disclose a hydrostatic winch having an overspeed control system which corrects a load overspeed condition, and a fail safe system which will smoothly stop the load in the event the overspeed control system becomes ineffective or some other abnormal condition occurs in the hydraulic system.

The foregoing and other objects and advantages of the invention will appear from the following description. In the description, reference is made to the accompanying drawings which form a part hereof, and in which there is shown by way of illustration and not of limitation, a preferred embodiment of the invention. Such embodiment does not represent the full scope of the invention, and reference is made to the claims herein for interpreting the breadth of the invention.

DESCRIPTION OF THE PREFERRED EMBODIMENT

Figure 1:
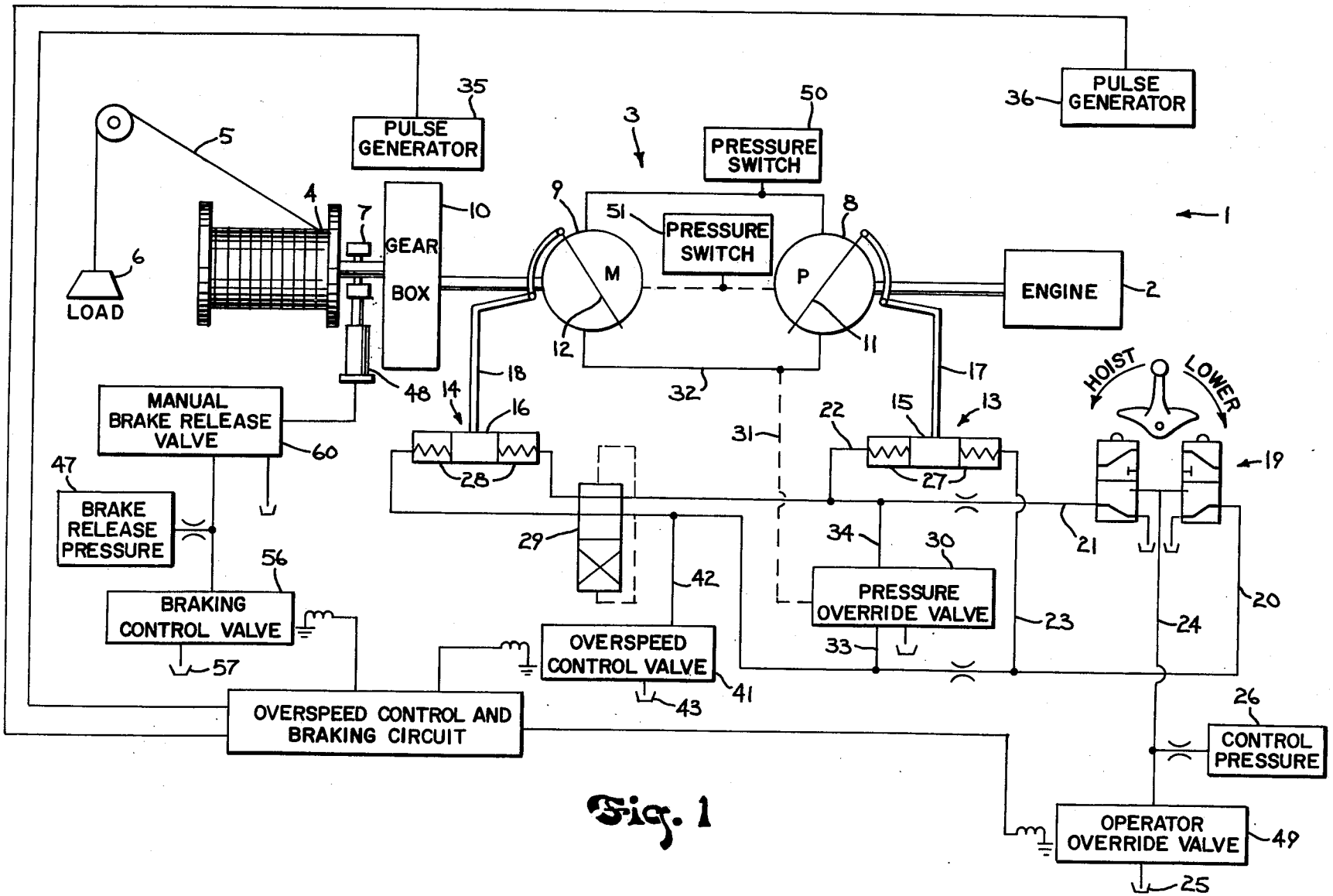
FIG. 1 is a schematic diagram of a hydrostatic winch embodying the present invention.

Referring to FIG. 1, there is shown in schematic form a hydrostatic winch assembly 1 having an engine 2, a hydraulic pump and motor assembly 3, a winch drum 4, a cable 5, a load 6 and a brake 7 for stopping the movement of the load 6.

An internal combustion engine 2 or other prime mover drives a reversible variable displacement pump 8. The outlet port of the pump 8 is connected to the inlet port of a variable displacement motor 9, and the outlet port of the motor 9 is connected to the inlet port of the pump 8. Thus, a closed-loop hydraulic circuit is formed between the pump 8 and motor 9 such that the hydraulic fluid pumped by the pump 8 drives the motor 9 to hoist, lower or hold the load 6. The motor 9 may be connected to the winch drum 4 through a gear box 10, and the winch drum 4 includes the cable 5 wound around its circumference. The load 6 is at the end of the cable 5. Thus, operation of the motor 9 takes up or pays out the cable 5 to raise or lower the load 6.

The combination of a reversible variable displacement pump 8 and a variable volume motor 9 provides a line speed for the load 6 which is as fast as the engine horsepower will allow. This variability enhances winch performance by having the ability to provide high line speed with low pressure and low line speed with high pressure on an approximately constant engine horsepower basis.

To control the hydrostatic winch assembly 1, the pump 8 and motor 9 are provided with pivotal control plates, or swash plates 11 and 12, respectively. These swash plates 11 and 12 may be in a neutral position, when the load 6 is being held stationary, or they may be rotated to positions on either side of this neutral position, corresponding to forward and reverse drive of the motor 9. Therefore, as the displacement of the pump 8 is increased by its swash plate 11, the pump 8 will put out more fluid causing the motor 9 to increase its speed when the position of the motor's swash plate 12 remains constant. Further, as the displacement of the motor 9 is decreased, the motor 9 will increase its speed when the rate of fluid being fed to it remains constant. Thus, the various displacement combinations allowed by the swash plates 11 and 12 provide variable high speed operation for the winch assembly 1.

The position of the swash plates 11 and 12, and thus the displacement of the pump 8 and motor 9, are controlled by conventional cylinder-piston arrangements 13 and 14, respectively. These arrangements have pistons 15 and 16 that are connected through linkages 17 and 18 to the swash plates 11 and 12, respectively. When the pistons 15 and 16 are in their neutral positions, the swash plates 11 and 12 are in their neutral positions. However, when the pistons 15 and 16 are moved, the swash plates 11 and 12 swing out of their neutral positions to change the displacement of the pump 8 and motor 9.

The cylinder-piston arrangements 13 and 14 are in turn operated by a variable pressure reducing dual valve 19 through which an operator directs control pressure. The central position of the dual valve 19 corresponds to the neutral positions of the pistons 15 and 16, and the swash plates 11 and 12. As seen in FIG. 1, the leftward or counterclockwise position of the dual valve 19 corresponds to hoisting, and the rightward or clockwise position corresponds to lowering the load 6.

The cylinder-piston arrangements 13 and 14 are connected to the dual valve 19 by means of a hydraulic circuit. As seen in FIG. 1, hydraulic line 20 is connected to the left end of the cylinder 14, and to the lowering side of the dual valve 19. A second hydraulic line 21 is connected to the right end of the cylinder 14 and to the hoisting side of the dual valve 19. The hydraulic lines 20 and 21 are also connected to the left and right ends of the cylinder 13 by means of the hydraulic lines 22 and 23, respectively. The dual valve 19 is also connected by means of a hydraulic line 24 to a reservoir 25 and a source of control pressure 26 in such a manner that when the dual valve 19 is moved to its hoist position, the control pressure enters lines 21 and 22, and when moved to its lower position, the control pressure enters lines 20 and 23. In the position as illustrated in FIG. 1, the dual valve 19 effectively blocks control pressure, and the pistons 15 and 16 as well as the swash plates 11 and 12, will be in their neutral positions. The load 6 will remain stationary because a set of springs 27 and 28 disposed within the cylinders 13 and 14 automatically moves the pistons 15 and 16 into their neutral position when no control pressure is applied.

Between the hydraulic lines 20 and 21, there is provided a crossover shuttle valve 29. This valve 29 has two positions. Its first position will allow fluid in hydraulic lines 20 and 21 to pass through unchecked. However, in its second position, the valve 29 causes the fluid flowing from the dual valve 19 in line 20 to cross over into line 21 to enter the right end of the cylinder 14, and the return fluid leaving the left end of the cylinder 14 in line 20 to cross back over into line 21. The crossover shuttle valve 29 is effective to produce the desired result of decreasing the displacement of the motor 9 whenever an increase in speed is desired, whether the operation is hoisting or lowering the load 6. As can be seen in FIG. 1, if it is desired to hoist the load 6, the dual valve 19 is moved to the left or counterclockwise causing control pressure to be applied at the left end of the cylinder 13 to increase the displacement of the pump 8 in the hoist direction, and at the right end of the cylinder 14 to decrease the displacement of the motor 9 at its high pressure inlet to increase motor speed. The crossover shuttle valve 29 must therefore be in the position shown in FIG. 1. If it is desired to lower the load 6, the dual valve 19 is moved to the right or clockwise causing control pressure to be applied at the right end of the cylinder 13 to increase the displacement of the pump 8 in the lowering direction. Since it is desired to reduce the displacement of the motor 9 whenever the operator wants increased speed, the control pressure must still be applied to the right end of the cylinder 14. Therefore, the crossover shuttle valve 29 is piloted to its second position to allow the high pressure fluid flowing in line 20 to cross over to line 21.

There is also provided a pressure override valve 30 between hydraulic lines 20 and 21. This valve 30 operates to reduce the pressure differential between the lines 20 and 21, resulting in a limitation of the motor displacement reduction called for by the control pressure command from dual valve 19, and a limitation of pump displacement, so that constant horsepower is provided to the system. As seen in FIG. 1, a pilot line 31 runs from the bottom hydraulic line 32 of the pump and motor assembly 3 to the override valve 30 which in turn is connected by a pair of pressure lines 33 and 34 to the hydraulic lines 20 and 21, respectively. When the load 6 is being lowered there is in effect a back pressure in the bottom line 32 of the pump and motor assembly 3, and increased pressure also occurs in this bottom line 32 when a heavy load is being hoisted. If the pressure in this bottom line 32 exceeds a predetermined level, then the pilot line 31 pilots the pressure override valve 30 to its open position. The pressure override valve 30 effectively reduces the speed of the load being hoisted or lowered by decreasing the pressure differential in lines 20 and 21 in order to maintain a constant horsepower output for the hydrostatic winch 1.

If for any reason there exists an overspeed of the load 6 in the hydrostatic winch assembly 1, speed control regulation will be initiated by the control arrangement which will now be described. Overspeed may be sensed by a pulse generator or counter 35 at the gear box 10 counting gear teeth, or by a pulse generator 36 at the engine 2; an unacceptable high pulse rate indicating overspeed. For purposes of illustration, the operation of the control arrangement as it responds to overspeed sensed by pulse generator 35 which monitors rotational velocity of the gear box 10 will now be described.

Figure 2:
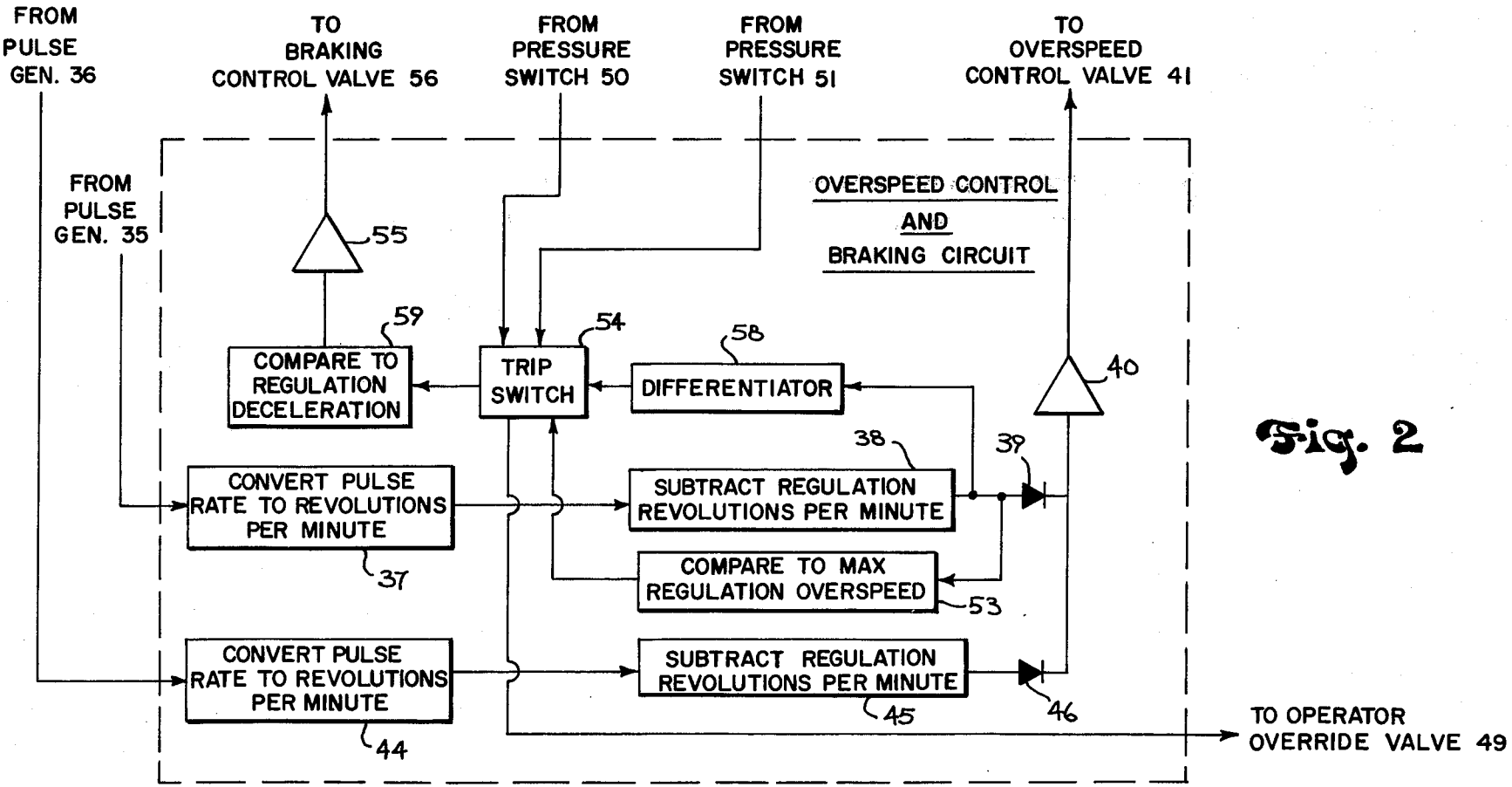
FIG. 2 is a schematic diagram of a control circuit for the hydrostatic winch of FIG. 1.

As schematically illustrated in FIG. 2, the pulses generated by the pulse generator 35 are fed to an overspeed control circuit which includes a velocity converter 37, a velocity bias or reference voltage, a velocity summing junction 38, and a velocity diode 39. The velocity converter 37 converts the frequency signal received from the pulse generator 35 to voltage. The velocity bias or reference voltage, generated for example by a potentiometer, meets the converted voltage at the velocity summing junction 38, which could be an operational amplifier. If the net voltage produced by the velocity summing junction 38 is positive, indicating overspeed, an overspeed signal passes through the velocity diode 39 to a gain amplifier 40 and directly to an overspeed control valve 41. If the net voltage is negative, indicating no overspeed, the diode 39 does not allow the signal to pass to the valve 41. The overspeed control valve 41 must be a high response electronic relief valve with flow proportional to voltage or current capabilities, such as a servo valve, to obtain the desired speed control. The overspeed control valve 41 will open in proportion to the magnitude of the overspeed signal produced at the velocity summing junction 38. The overspeed control valve 41 is connected at one end by a pressure line 42 to the hydraulic fluid line 20, and its other end leads to a reservoir 43. When an overspeed signal is received by the overspeed control valve 41 causing it to open, it will bleed pressure from the hydraulic line 20. This will also bleed pressure from hydraulic line 23 leading from the right end of the cylinder 13. The greater the overspeed signal received, the greater the overspeed control valve 41 reduces the pressure in lines 20 and 23. Lowering the pressure in line 20 will increase motor displacement, and at the same time the lowering of pressure in line 23 will decrease pump displacement. Both of these actions reduce the line speed of the load 6 to bring the hydrostatic winch 1 back in control. The described overspeed control mechanism, however, never moves the swash plate 11 of the pump 8 to a position of zero displacement.

Overspeed control may also be initiated by pulses generated from an engine pulse generator 36. These pulses are analyzed in a separate but identical control circuit as the pulses from the gear box 10 and have their own converter 44; summing junction 45; and diode 46. Furthermore, a different bias voltage would also be applied at the summing junction 45 as a desired reference. The net signal produced at the summing junction 45, if positive, is then fed to the overspeed control valve 41 through the diode 46 and the gain amplifier 40 in the same manner as the pulses originating from the gear box 10.

The overspeed control system described above will not allow an operator to achieve a faster speed than is safe for the load being handled and will override any control of line speed an operator normally has through the dual valve 19 during an overspeed condition.

The fail safe system preferably includes a braking system and an operator control override system.

The braking system includes the brake 7 which is preferably a conventional spring set, pressure release type brake which is positioned about the shaft of the gear box 10, and a source of brake release pressure 47. Representative of a brake that can be used is the Bucyrus-Erie Company Brake Model No. 55. The brake 7 is held off the shaft by a hydraulic cylinder 48 so long as full pressure is being applied to it. However, as soon as pressure in the cylinder 48 is reduced, the springs (not shown) within the brake assembly apply the brake 7 to the shaft to slow the winch drum 4.

The operator control override system includes an operator override valve 49 which drains control pressure from the dual valve 19 and removes control from the operator.

To provide a controlled stopping of the load the fail safe system also includes sensing devices, such as pressure switches 50 and 51, to detect abnormal conditions and to activate the braking and operator override systems. FIG. 1 illustrates that pressure switch 50 may be used to signal a broken hydraulic line such as could occur if the pressure in the low pressure line 32 of the pump and motor assembly 3 is less than 100 psi, for example. Pressure switch 51 might signal plate separation if the pump and motor case drain pressure is greater than 80 psi, for example. It should be noted that those skilled in the art may determine that other system failure sensing devices could be used along with the pressure switches 50 and 51 to detect abnormal conditions in the system.

The fail safe system can also be activated by an overspeed comparator 53, such as an operational amplifier. The overspeed comparator 53 compares the net signal produced at the velocity summing junction 38 to an overspeed bias or control signal which represents a maximum overspeed, such as 115% of the desired operating speed. If the net signal is greater than the 115% bias signal, a resultant signal is produced and the braking system and operator control override systems of the fail safe system will be activated as described below.

If one of the above pressure switches 50,51 or the overspeed comparator 53, indicates an abnormal condition, a trip switch 54 is tripped. The tripping of switch 54 sends a pressure control signal to an operator override valve 49, such as a solenoid or a servo valve, to open and drain the control pressure leading to dual valve 19. This action causes the pump 8 and motor 9 to be stroked to their neutral or zero displacement positions, and removes any control an operator may have on the system.

At the same time control pressure is being drained, trip switch 54 causes a brake command signal to be sent through a brake gain amplifier 55 to a braking control valve 56. The braking control valve 56 must be of the high response, flow proportional to voltage or current type of valve, such as a servo valve. The braking control valve 56 is connected to the source of brake release pressure 47 and a reservoir 57 in such a manner that it will bleed that pressure in an amount proportional to the magnitude of the brake command signal it receives.

The fail safe control system further includes a feedback system which provides the feedback necessary for a smooth stop of the load 6. The net signal generated at the velocity summing junction 38 is fed to a differentiator 58, such as a capacitor or a differential amplifier, which in effect converts winch velocity to winch angular acceleration. The signal thus generated then meets a bias or reference brake signal at a brake summing junction 59 and the net signal, which is the brake command signal, is then fed to the braking control valve 56 which will respond accordingly by bleeding brake pressure proportionately to apply the brake 7 hard enough to accomplish the smooth stop of the load 6. If the net signal indicates that the load 6 is still accelerating, such as in the case of an extremely heavy load, greater braking force will be applied by the brake 7 because the braking control valve 56 will continue to cause the bleeding off of more brake release pressure until the feedback signal indicates a decrease in acceleration. This feedback system operates continuously until the load 6 is stopped, and completely overrides any operator control through the dual valve 19.

There is also provided a manual brake release system which includes a valve 60 which opens and drains brake release pressure to set the brake 7. The valve 60 is located between the brake 7 and the source of brake release pressure 47, and would normally be opened by the tripping of a switch at the operator's console. However, it should be noted that the tripping of the manual brake release system will not provide smooth braking action, but instead will "slam" the brake on to stop the load 6.

In addition to the automatic fail safe system and the manual brake release system described above, there may also be provided a manual foot brake which the operator could use to apply the brake 7 to stop the load 6 from falling.

After the fail safe system has been tripped and the necessary repairs have been made to the winch assembly 1, the trip switch 54 must be reset before any hoisting or lowering action may resume. This is done by resetting a switch located at the operator's console.

OPERATION

Under normal operation, if it is desired to hoist the load 6, the dual valve 19 is moved to the left causing control pressure to be felt at the left end of the cylinder 13 and at the right end of cylinder 14. This increases pump displacement in the hoist direction and decreases motor displacement resulting in increased motor speed. When hoisting, the crossover shuttle valve 29 is in its first position as illustrated in FIG. 1.

If it is desired to lower the load 6, the dual valve 19 is moved to the right causing control pressure to be felt at the right end of the cylinder 13, and at the right end of the cylinder 14 due to the fact that the shuttle valve 29 is piloted to its second, or crossover position. This action increases pump displacement in the lowering direction, and decreases motor displacement resulting in increased motor speed.

If excess pressure builds up in the bottom line 32 of the pump and motor assembly 3, such as from high back pressure when lowering, or high pressure when hoisting a very heavy load, the pressure override valve 30 will open to reduce the pressure differential between lines 20 and 21 which reduces motor speed. This override valve 30 reduces the speed of the load in order to maintain a constant horsepower output for the winch assembly 1.

If for any reason there exists an overspeed condition for the load as sensed by the pulse generatores 35 and 36, speed control regulation will be initiated by means of an overspeed control circuit and overspeed control valve 41. The overspeed control circuit converts the pulse rates received from generators 35 and 36 from frequency signal to voltage, compares this voltage with a bias or control voltage, and if the resulting voltage is positive, passes this net signal to the overspeed control valve 41. The higher the net overspeed signal, the lower the overspeed control valve 41 drops control pressure in lines 20 and 23. This action increases motor displacement, and decreases pump displacement resulting in decreased line speed for the load 6.

Abnormal conditions in the system are sensed by pressure switches 50 and 51, and an undesirably high overspeed condition may be identified by the overspeed comparator 53. If any one of these devices trips switch 54, operator override valve 49 is energized to drain all control pressure from the dual valve 19 so that the pump 8 and motor 9 are moved to their zero displacement positions by the cylinder-piston arrangements 13 and 14. At substantially the same time, the tripping of switch 54 causes a differentiator 58 to convert the net signal leaving the velocity summing junction 38 from a velocity signal to an acceleration signal. This acceleration signal meets a brake reference signal at a brake summing junction 59 and the net signal, the brake command signal is fed to the braking control valve 56. The braking control valve 56 then opens in proportion to the magnitude of the signal received to release pressure from the hydraulic cylinder 48. This causes the brake 7 to be spring set on the shaft. The winch acceleration signal is continuously compared with the brake reference signal and fed to the braking control valve 56 to accomplish a smooth stop of the load 6. The trip switch 54 which was tripped by initiating the fail safe control system must be reset by the operator before hoisting or lowering may resume.

A winch has been described that has a control arrangement which not only controls the overspeed of a load on the winch assembly, but which also applies a brake to smoothly stop the load in the event an abnormal condition occurs in the system. The control arrangement may be designed for any size winch desired. Also, the control arrangement can be used in series with loads associated with crane operation other than just raising and lowering a load with a winch. For example, the control arrangement could be used for raising and lowering a boom, or to control an auxiliary winch in addition to the main winch. Various converters, comparators, differentiators, switches, valves and sensing devices known to those skilled in the art might be substituted. Thus, in view of the possible modifications, the present invention is not intended to be limited by the showing or description herein, or in any other manner, except insofar as may specifically be required by the claims which follow.

I claim:

1. A hydrostatic winch including a hydraulic control system with a dual valve for adjusting pressure in control lines to drive a winch to hoist or lower a load and a brake for stopping the movement of the winch and the load which is characterized by:

(A) an overspeed control system including:
- (1) a valve for bleeding pressure from a control line to slow the winch; and
- (2) valve control means which detects overspeed and activates the valve to slow the winch; and (B) a fail safe system for smoothly stopping the winch and load, if necessary, including:
- (1) a normally "off" brake biased towards an "on" position and held in the "off" position by pressure in a hydraulic cylinder;
- (2) a valve for bleeding pressure from the hydraulic cylinder;
- (3) first means for detecting when the speed of the load or winch is exceeding a predetermined limit;
- (4) second means for detecting when an abnormal condition exists which could cause overspeed; and
- (5) control means for the valve for bleeding pressure from the hydraulic cylinder, which control means is activated by receipt of a signal from either first or second means to bleed pressure from said cylinder to apply the brake to smoothly stop the load.

2. The hydrostatic winch of claim 1 in which the fail safe system also includes an operator control override system including an operator control override valve on the control lines for the dual valve, operator control override valve control means and means for activating the valve control means when overspeed or an abnormal condition exists to bleed pressure from the control lines and override the operator's control of the dual valve.

3. The hydrostatic winch of claim 1 in which the valve control means of the overspeed control system includes sensing means for detecting the speed of the winch, comparing means for comparing the detected speed with a predetermined standard and if the detected speed exceeds the standard automatically opening the valve to bleed pressure from the control lines of the dual valve.

4. The hydrostatic winch of claim 1 in which the first means of the fail safe system is a pulse sensor which determines winch speed.

5. The hydrostatic winch of claim 1 in which the second means of the fail safe system is a pressure sensor for detecting an abnormal pressure drop in the hydraulic system of the winch.

6. The hydrostatic winch of claim 1 in which the control means for the valve for bleeding pressure from the hydraulic cylinder of the braking system is activated by a signal from either the first means or the second means.

7. In a hydrostatic winch including a hydraulic control system with a dual valve for adjusting pressure in control lines to drive a winch to hoist or lower a load and a brake for stopping the movement of the winch and the load which is characterized by:

(A) an overspeed control system including:

(1) a valve for bleeding pressure from a control line to slow the winch, and (2) valve control means which detects overspeed and activates the valve to slow the winch; and (B) a fail safe system including a braking system and an operator control override system in which the braking system includes:

(1) a normally "off" brake biased towards an "on" position and held in the "off" position by pressure in a hydraulic cylinder;

(2) a valve for bleeding pressure from the hydraulic cylinder;

(3) first means for detecting when the speed of the load or winch is exceeding a predetermined limit;

(4) second means for detecting when an abnormal condition exists which could cause overspeed; and (5) control means for the valve for bleeding pressure from the hydraulic cylinder, which control means is activated by receipt of a signal from either first or second means to bleed pressure from said cylinder to apply the brake to smoothly stop the load.

8. The hydrostatic winch of claim 7 in which the operator control override system includes an operator control override valve on the control lines for the dual valve, operator control override valve control means and means for activating the valve control means when overspeed or an abnormal condition exists to bleed pressure from the control lines to override the operator's control of the dual valve.

9. The hydrostatic winch of claim 7 in which the valve control means of the overspeed control system includes sensing means for detecting the speed of the winch, comparing means for comparing the detected speed with a predetermined standard and if the detected speed exceeds the standard automatically opening the valve to bleed pressure from the control lines of the dual valve.

10. The hydrostatic winch of claim 7 in which the control means for the valve for bleeding pressure from the hydraulic cylinder of the braking system is activated by a signal from either the first means or the second means.

* * * * *